United States Patent [19]

Eggers et al.

[11] Patent Number: 4,613,797

[45] Date of Patent: Sep. 23, 1986

[54] FLASH STROBE POWER SUPPLY

[75] Inventors: Frederick W. Eggers, Folsom, Calif.; Paul D. Graham; Bruce E. Heeb, both of Frankfort, Ill.

[73] Assignee: Federal Signal Corporation, Oak Brook, Ill.

[21] Appl. No.: 635,132

[22] Filed: Jul. 27, 1984

[51] Int. Cl.[4] ..... H05B 41/30; H05B 41/34

[52] U.S. Cl. ..... 315/241 R; 315/241 S; 315/240; 315/230; 315/237

[58] Field of Search ..... 315/241 R, 241 S, 240, 315/230, 232, 237

[56] References Cited

U.S. PATENT DOCUMENTS

| | | | |
|---|---|---|---|
| 3,644,818 | 2/1972 | Paget | 315/241 S X |
| 3,714,508 | 1/1973 | Harnden, Jr. et al. | 315/241 R |
| 3,769,545 | 10/1973 | Crane | 315/241 R X |
| 3,828,222 | 8/1974 | Mason | 315/240 X |
| 3,946,271 | 3/1976 | Stepp et al. | 315/241 S |
| 4,005,337 | 1/1977 | Rabe | 315/241 R X |
| 4,013,921 | 3/1977 | Corthell | 315/241 R |
| 4,142,130 | 2/1979 | Ingalls | 315/241 R X |

OTHER PUBLICATIONS

Aver'yanov, "Control of the Supply of Flashlamps", *Instruments and Experimental Techniques,* vol. 18, No. 2, pt. 2, pp. 531-533, Mar.-Apr. 1975, Plenum Publishing, New York, N.Y.

*Primary Examiner*—David K. Moore
*Assistant Examiner*—Vincent DeLuca
*Attorney, Agent, or Firm*—Charles F. Pigott, Jr.

[57] ABSTRACT

A flash strobe power supply adapted for controlling alternately the energization of a pair of flash lamps includes a trigger timing device for generating a series of positive pulses and a series of negative pulses spaced in time from the positive pulses by a predetermined interval. First and second energy storage devices are provided for repeatedly charging incrementally during successive charging cycles and for storing a charge to be applied to respective first and second flash lamps. An inverter oscillator circuit includes a pulse width modulator and a transformer for generating a quasi-squarewave signal whose frequency is greater than the frequency of the positive and negative pulses to control the incremental charging of the energy storage devices. First and second switching devices deliver when conductive the charge stored in the first and second energy storage devices to their respective first and second flash lamps. A first switching means is responsive to the positive pulses of the timing device for rendering it conductive to permit the discharging of the charge stored in the first energy storage device through the first flash lamp. The second switching device is responsive to the negative pulses of the timing device for rendering it conductive to permit the discharging of the charge stored in the second energy storage device through the second flash lamp. Antisaturation circuit responsive to the quasi-squarewave signal prevents saturation of the primary winding of the transformer by disabling of the pulse width modulator which avoids further incremental charging of the first and second storage devices.

20 Claims, 5 Drawing Figures

FLASH STROBE POWER SUPPLY

BACKGROUND OF THE INVENTION

This invention relates generally to flash-producing electrical circuits for use with a flash lamp device and more particularly, it relates to an improved flash strobe power supply having energy storage devices and a trigger timing circuit for the respective charging and firing of a flash lamp disposed remotely therefrom without the effects of neoning, saturation and overcharging.

Heretofore, flash lamp assemblies have been generally made as an integral unit housing all of the associated electronic components therein. These electronic components would include main storage means for providing the main supply potential or flash-producing voltage applied to the two principal electrodes of a flash tube as well as a timing or firing means for producing trigger impulses applied to the trigger electrode of the flash tube. The timing means includes a trigger capacitor with a resistor and a switching device. In such conventional flash lamp assemblies of the prior art, all three electrodes (the two principal electrodes and trigger electrodes) must be connected to external circuity and thus could not be simply inserted into a conventional incandescent lamp socket which has only a two-contact receptacle.

A new improved flash lamp assembly is disclosed in U.S. patent application Ser. No. 376,752 entitled "Flash Lamp" filed on May 10, 1982 which has now matured into U.S. Pat. No. 4,463,282 issued on July 31, 1984, and assigned to the assignee as the present application, which has eliminated the main storage means and timing means from its internal housing. This improved flash lamp in Ser. No. 376,752 requires both an external trigger timing means and storage means for providing main supply potential and is adapted to permit its insertion into an incandescent lamp receptacle having only the two-contact receptacle. We have discovered a new and improved flash strobe power supply having energy storage devices and a trigger timing means for driving the new flash lamp assembly disclosed in the said copending application.

In the art of flash tubes, it is known that if the voltage applied between the principal electrodes of a flash tube is below a certain level or minimum starting voltage, the discharge of a singular "flash" of radiant energy across the spark gap will not be initiated regardless of how high the potential of the trigger impulse is. Therefore, the flash tube required an electric power supply capable of charging an energy storage device such as a flash capacitor with a voltage higher than the minimum starting voltage. However, if the power source contains excess energy in magnitude or the flash capacitor is charged during the time of the flash, the flash could fail to extinguish after the single flash and produce radiant energy continuously. This effect is referred to as "neoning" by those skilled in the art.

Flash tubes nowadays have a trigger electrode that can be energized to produce sufficient energy to flash the tube at a somewhat lower applied voltage, but still requires a voltage in the order of 160 to 200 D.C. volts. This may cause unsafe or harmful operating conditions due to the increased probability of occurrence of electric shocks at these high voltage levels. Therefore, it would be desirable to provide a flash strobe power supply which could accommodate a relatively low battery voltage of 12 or 24 D.C. volts so as to avoid any dangers.

With the recent development of "double flash" flash tubes where two or more flashes are generated over a short period of time and separated by a longer time delay and then followed by two or more flashes to produce the effect of a single flash of longer duration or a pair of individual flashes closely spaced together, prior art power supplies have used the same flash capacitor circuit for producing the second flash that powered the first flash. These prior art power supplies suffered from the disadvantage in causing the "neoning" problem to occur in the flash tube due to the subsequent recharging of the same capacitor. It would be desirable to have a new power supply with independently charged capacitors for producing each of the first and second flashes.

In other prior art systems which employ an inverter-type power supply having a transformer for transferring stored energy to a capacitor to fire a flash lamp, the oscillation cycle was established by operating the transformer into saturation. However, since the inductance of the transformer is minimum at saturation optimum energy was not obtained and significant loss occurred due to thermal dissipation by heating of the transformer. An additional problem encountered in the prior art is the allowance of the storage capacitors to continue to increase without limit to a level which could cause damage or destruction to the flash tube.

The power supply of the present invention is capable of providing charged flash voltages and trigger pulses for a flash tube which overcomes all of the above-discussed disadvantages. The power supply is adapted to provide repeatedly either a singular "flash" of radiant energy alternatingly to a pair of flash lamps or a "double flash" of radiant energy to a single flash tube which eliminates the problems of neoning in the flash tubes, saturating of the inverter transformer, and overcharging of the storage capacitors.

SUMMARY OF THE INVENTION

Accordingly, it is a general object of the present invention to provide a new and improved flash strobe power supply which overcomes each and every one of the disadvantages suffered in the prior art.

It is an object of the present invention to provide a flash strobe power supply for delivering repeatedly either a single burst of intense energy alternatingly to a pair of flash lamps or a double burst of intense energy to a single flash lamp without the problems of "neoning", saturation and overcharging.

It is another object of the present invention to provide a flash strobe power supply which includes first and second energy storage means for repeatedly charging incrementally during successive charging cycles and for storing charges to be applied to the principal electrodes of respective first and second flash lamps through respective first and second switching means.

It is still another object of the present invention to provide a flash strobe power supply which includes an overvoltage shut-off means for preventing energy storage means from charging beyond a predetermined level.

It is still yet another object of the present invention to provide a flash strobe power supply which includes anti-neoning circuit means for turning off an inverter oscillator circuit at the time of flashing so as to avoid charging of energy storage means.

It is still yet another object of the present invention to provide a flash strobe power supply which includes anti-saturation circuit and turnoff feedback means for preventing saturation of a transformer winding in an inverter oscillator circuit by disabling of the oscillator so as to eliminate charging of energy storage means.

Yet, it is still another object of the present invention to provide a power supply for delivering energy to flash lamp assemblies suitable for connection to existing two-contact receptacle.

In accordance with these aims and objectives of the present invention, there is provided a flash strobe power supply adapted for controlling alternately the energization of a pair of flash lamps which includes trigger timing means for generating a series of positive pulses and a series of negative pulses spaced in time from the positive pulses by a predetermined interval. First and second energy storage means are provided for repeatedly charging incrementally during successive charging cycles and for storing a charge to be applied to respective first and second flash lamps. An inverter oscillator circuit responsive to a D.C. source includes a pulse width modulator and a transformer for generating a quasi-square wave signal whose frequency is greater than the frequency of the positive and negative pulses to control the incremental charging of the first and second energy storage means. First and second switching means are provided for delivering when conductive the charge stored in the respective first and second energy storage means to the respective first and second flash lamps. The first switching means is responsive to the positive pulses of the timing means for rendering it conductive to permit the discharging of the charge stored in the first energy storage means through the first flash lamp. The second switching means is responsive to the negative pulses of the timing means for rendering it conductive to permit the discharging of the charge stored in the second energy storage means through the second flash lamp. Anti-saturation means responsive to the quasi-square wave signal is provided for preventing saturation of the primary winding of the transformer by disabling of the pulse width modulator which avoids further incremental charging of the first and second storage means.

BRIEF DESCRIPTION OF THE DRAWINGS

These and other objects and advantages of the present invention will be more fully apparent from the following detailed description when read in conjunction with the accompanying drawings with like reference numerals indicating corresponding parts throughout, wherein.

DESCRIPTION OF THE PREFERRED EMBODIMENT

Figure 1:
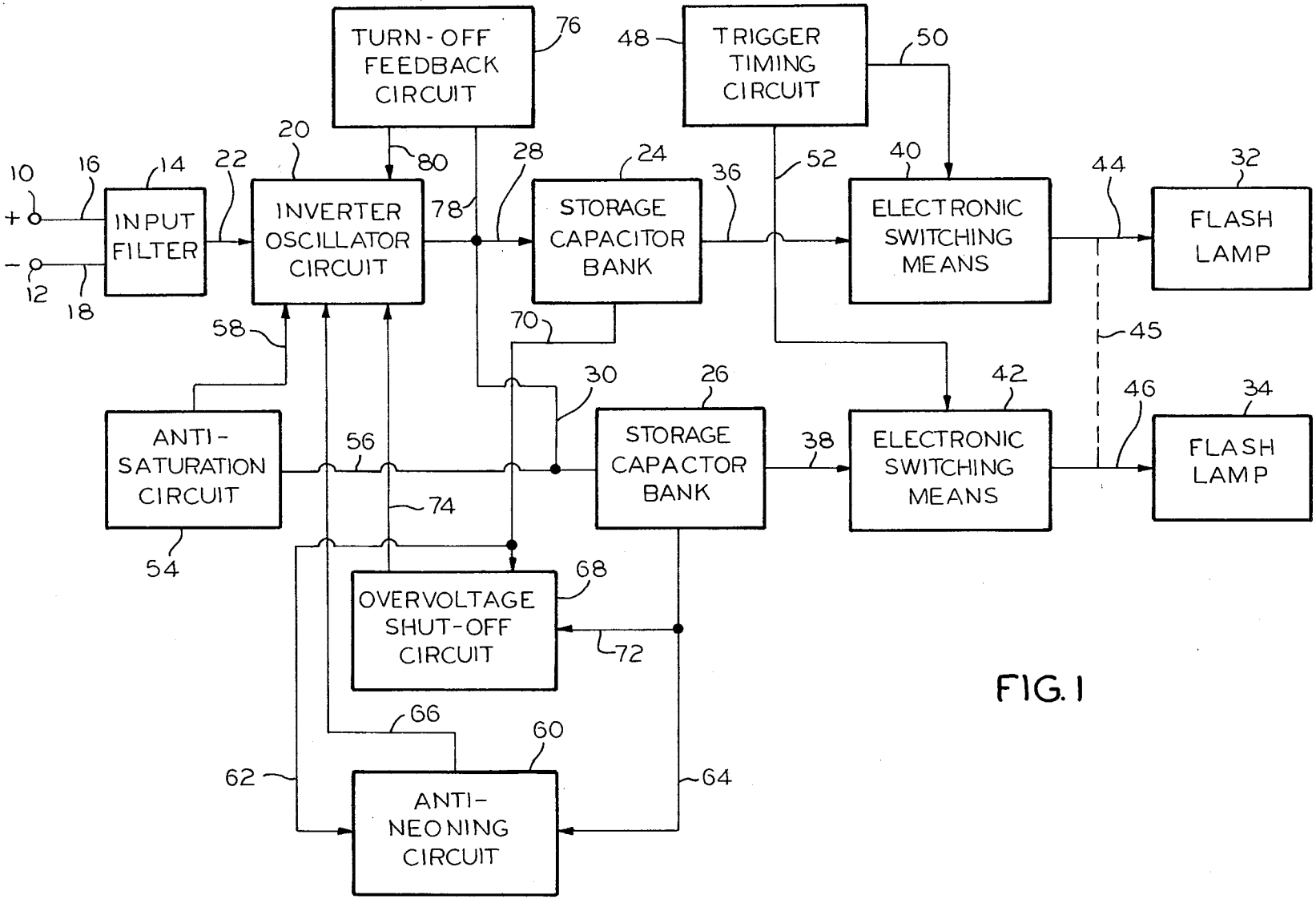
FIG. 1 is a block diagram of a flash strobe power supply embodying the principles of the present invention.

Referring now in detail to FIG. 1 of the drawings, there is shown in block diagram form a flash strobe power supply of the present invention which is adapted for connection to a D.C. power supply such as a battery via a positive terminal 10 and negative or ground terminal 12. The power supply includes an input filter 14 coupled to the terminals 10 and 12 via lead lines 16, 18 and an inverter oscillator circuit 20 connected to the output of the filter 14 via line 22. The inverter oscillator circuit 20 provides for controlling the rate of charging of storage capacitor banks 24, 26 via lines 28, 30 in an alternating and incremental manner to a voltage level sufficient to flash sequentially respective flash lamps 32, 34. The outputs of the capacitor banks 24, 26 are delivered to electronic switching means 40, 42 via lines 36, 38. The capacitor voltages are applied via lines 44, 46 to the main terminals of the flash lamps 32, 34 when the switching means are closed. A trigger timing circuit 48 controls the conduction of the switching means 40, 42 via output lines 50, 52, which are connected to the control or gate terminals of the respective switching means.

In order to prevent the primary winding of a transformer in the inverter oscillator circuit 20 from going into saturation, an anti-saturation circuit 54 senses the output of the oscillator 20 via line 56 and is fed back to a second input of the oscillator circuit 20 on line 58. To avoid the problem of neoning, an anti-neoning circuit senses the output of the capacitor banks 24, 26 via lines 62, 64 to generate an output signal on line 66 for shutting off the oscillator circuits 20 at the time of the flash occurring in the flash lamps. An overvoltage shut-off circuit 68 also senses the outputs of the capacitor banks 24, 26 via lines 70, 72 which generate an output signal on line 74 for shutting off the oscillator circuit 20 when the voltage of the capacitor bank 26 exceeds a predetermined value level. A turn-off feedback circuit 76 is connected to the output of the oscillator circuit via line 78 to generate a feedback signal on line 80 to a third input of the oscillator circuit to assist in turning off quickly the oscillator circuit to prevent saturation of the primary winding of the transformer.

Figure 2:
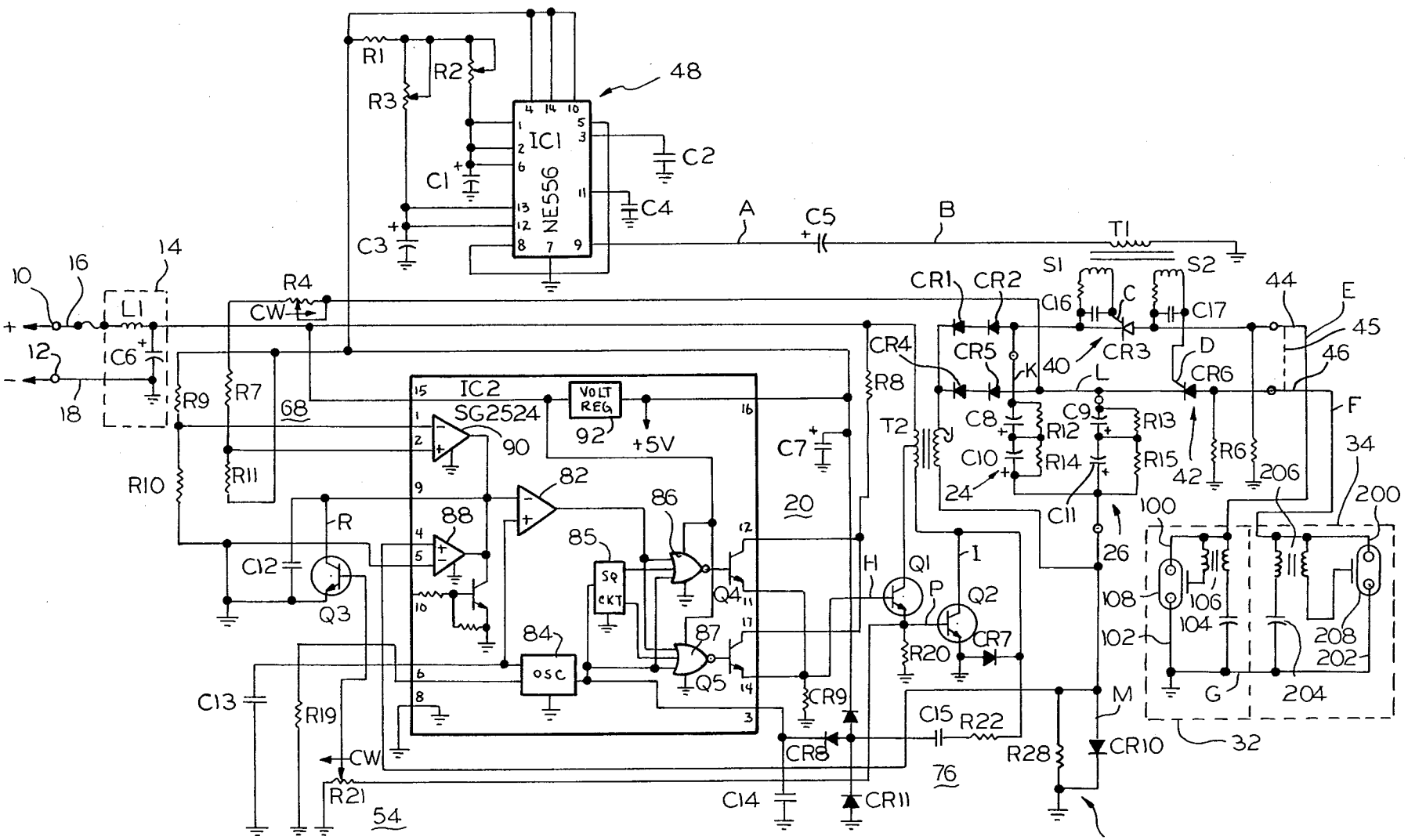
FIG. 2 is a detailed schematic circuit diagram of the present invention shown in FIG. 1.

Turning now the detailed schematic circuit diagram of FIG. 2, it can be seen that the input filter 14 consists of a series inductor L1 and a shunt capacitor C6 defining a line filter. An input filter 14 performs the function of eliminating any high voltage transients and prevents the D.C. power source from being modulated by the pulsating current in the inverter oscillator circuit 20. Such modulation would cause RFI signals to be fed back to the power source tending to interfere with other equipment.

The output on line 22 of the filter 14 is connected to an input of the inverter oscillator circuit 20 which comprises a monolithic integrated circuit IC2, a transformer T2, a drive transistor Q1, and a power transistor Q2. The collector of the power transistor Q2 is connected to the positive terminal 10 of the D.C. power source via a series connected primary winding of the transformer T2. The emitter of the transistor Q2 is connected to the other side or ground of the power source terminal 12. The collector of the drive transistor Q1 is connected directly to a tap on the primary winding of the transformer T2. The emitter of the transistor Q1 is connected via a resistor R20 to the other side of the power source terminal 12 and to the base of the power transistor Q2. The base of the transistor Q1 is connected to the output of IC2 which is preferably a Signetics Corporation type SG2524 pulse width modulator. IC2 provides a pulse train with a variable frequency to control the "on" and "off" times of the transistor Q1 which, in turn, controls the "on" and "off" times of the transistor Q2.

When the transistor Q2 is turned on or conducts, current is supplied to the primary winding of the transformer T2 from the D.C. power source via the collector-emitter path of the transistor Q2. This current causes energy to be stored in the form of a magnetic field in the primary winding of the transformer T2. As soon as the transistor Q2 is turned off or rendered non-conductive, current will no longer be supplied to the primary winding. The magnetic field about the primary winding will collapse and the energy stored therein is inductively coupled or transferred to the secondary winding of the transformer T2 and will be stored subsequently in capacitor bank 24 formed of capacitors C8, C10 via diodes CR1, CR2 and in capacitor bank 26 formed of capacitors C9, C11 via diodes CR4, CR5. The capacitor C8, C10 are discharged through a flash lamp 32 via the switching means 40 consisting of a silicon-controlled rectifier CR3 upon the generation of trigger pulses in a manner to be described below. Similarly the capacitors C9, C11 are discharged through a flash lamp 34 via the switching means 42 consisting of a silicon-controlled rectifier CR6 upon the receipt of appropriate trigger pulses. Resistors R12, R14 and R13, R15 are conducted in parallel with the capacitors C8, C10 and C9, C11, respectively to assist in bleeding off the charge developed thereon when the power supply is not in use.

The trigger timing circuit 48 provides trigger pulses for controlling the discharge of the capacitors C8, C10 through the flash lamp 32 and the discharge of the capacitor C9, C11 through the flash lamp 34. The timing circuit 48 comprises a monolithic pulse generator or timer IC1 with associated components R1–R3 and C1–C4, a differentiating capacitor C5, and a pulse transformer T1. The timer IC1 is preferably a Signetics Corporation type NE556 dual timer which provides an output square wave with an adjustable duty cycle controlled by a portion of the associated components. The square wave output of the timer IC1 is connected to one side of the differentiating capacitor C5, and the other side of the capacitor is connected in series with the primary winding of a transformer T1. Positive and negative pulses are generated in synchronization with the leading and trailing edges of each positive half-cycle of the square wave output from the timer IC1.

The positive pulses appearing at the output of the differentiating capacitor C5 are coupled via the primary winding of the transformer T1, the secondary winding S1, and capacitor C16 to the control or gate electrode of the silicon-controlled rectifier CR3 which will be "fired" or rendered conductive since its cathode is tied to the negative terminal of the capacitor C8. This causes the voltage stored in capacitors C8, C10 to be applied across the main terminals 100, 102 of flash tube 108 and simultaneously an impulse will be applied to the control electrode of the tube 108. As can be seen from FIG. 2, the flash lamp 32 (34) is of the type disclosed in the aforementioned Ser. No. 376,752 which includes a flash tube 108 (208), trigger capacitor 104 (204) and transformer 106 (206) coupled together to form a unitary integral lamp. Thus, the tube 108 will ionize and emit an intense burse of light of a short duration.

Similarly, negative pulses appearing at the output of the differentiating capacitor C5 are applied via the primary winding of the transformer T1, the secondary winding S2, and capacitor C17 to the gate of the silicon-controlled rectifier CR6 which will be "fired" since its cathode is tied to the negative terminal of the capacitor C9. This causes the voltage stored in capacitors C9, C11 to be applied across the main terminals 200, 202 of flash tube 208 and simultaneously an impulse will be applied to the control electrode of the tube 208. Accordingly, the tube 208 will ionize and emit a second intense burst of light a short time after the first flash of light. A delay in the time interval between flashes is due to the spacing of the negative pulses relative to the positive pulses and is determined by the setting of the duty cycle in timer IC1.

As is known to those skilled in the art, the energy stored in the primary winding of the transformer T2 will increase as the current passed therethrough increases until saturation occurs. At saturation, the inductance of the primary winding will be minimum and thus any increased current will result in significant losses due to thermal dissipation. In order to avoid operating of the primary winding of the transformer T2 near saturation, the power supply of the present invention includes an antisaturation circuit 54 for sensing the voltage at the junction of the emitter of transistor Q1, the base of transistor Q2, and the resistor R20. This saturation sensing voltage is converted to a base current for driving a transistor Q3 via potentiometer R21. The transistor Q3 effects a certain degree of temperature compensation for the transistor Q2. The collector of transistor Q3 is fed to a comparator amplifier 82 in IC2. Only the essential components of IC2 required to understand the operation of the present invention is shown in block form of FIG. 2. When transistor Q3 is turned on, the comparator amplifier 82 causes the transistor Q1 to turn off by blocking the pulses from the oscillator 84 and squaring circuit 85 from reaching the base of the transistor Q1 via NOR gates 86, 87. In other words, the NOR gates are disabled. This results in narrowing of the width of the pulse train, thereby turning off the power transistor Q2 sooner. Consequently, the transistor Q2 prevents further current from the power source to pass through the primary winding of the transformer T1 so as to avoid saturation.

In order to assist in turning off quickly the transistor Q2, a turn-off feedback circuit 76 is provided for sensing the voltage at the junction of the collector of transistor Q2 and the primary winding of the transformer T2. The voltage is fed through resistor R22 and capacitor C15 to the junctions of diodes CR8, CR9 and CR11 which is maintained between 0.7 volts and 5.7 volts. When this junction voltage exceeds 5.6 volts, a voltage at the anode of the diode CR8 rendering it conductive is supplied to pin 3 of IC2 which is a conventional output terminal. This again causes the NOR gates 86, 87 to disable the pulses from the oscillator 84 and squaring circuit 85 thereby turning off the transistor Q1.

After the strobe or flash lamp 32, 34 has been fired, the respective storage capacitor bank 24, 26 must be recharged in preparation for the next successive firing. However, after the strobe lamps 32 and 34 are flashed, some of the gas in the lamps will remain ionized for a time in the effect called "neoning" where the lamps do not completely extinguish. If the capacitor bank 24 or 26 is recharged whihle the respective lamps is experiencing this neoning, a current will flow and the neoning effect will continue so that further firing of the lamps is prevented. In order to prevent this neoning effect from occurring, the power supply in the present invention includes an anti-neoning circuit 60 which inhibits the pulses from the oscillator 84 and the squaring circuit 85 from being delivered to the base of the transistor Q1. As a result, further energy storage in the primary winding of transformer T2 is avoided, thereby terminating the charging operation of the capacitors C8, C10 and capacitors C9, C11. The anti-neoning circuit 60 comprises a diode CR10 and the resistor R28 connected in parallel across the diode. The anode of the diode CR10 is connected to the common positive terminals of the capacitors C10, C11 and the cathode of the diode CR10 is tied to ground. In synchronism with the flashing of the lamps, a positive pulse will be generated at the anode of the diode CR10. This pulse is fed to a current-limit comparator 88 in IC2 which blocks the pulses from the oscillator 84 and squaring circuit 85 from reaching the base of transistor Q1 via the comparator 82 and NOR gates 86 and 87. Recharging of the capacitors is prevented for the duration of this pulse which is selected so as to be sufficient for the ionized gas in the lamps to be returned to its non-ionized state.

In order to eliminate the application of an excessive voltage across the flash lamp which may cause its destruction, the overvoltage shut-off circuit 68 of the power supply is provided. The overvoltage shut-off circuit comprises a first voltage divider formed of series resistors R9, and R10. The junction of resistors R9 and R10 is applied to the inverting input of an error amplifier comparator 90 in IC2. The other end of resistor R9 is tied to a reference voltage developed from voltage regulator 92 of the IC2, such as +5 volts D.C. A second voltage divider is formed of series connected potentiometer R4, resistor R7 and resistor R11 which detects the charged stored or voltage of the capacitors C9, C11. When the voltage at the juncture of resistors R7 and R11, which is fed to the non-inverting of a comparator 90, exceeds the divided voltage at the junction of resistors R9 and R10, the output of the comparator 90 causes the NOR gates 86, 87 to disable the pulses from the oscillator and squaring circuit from reaching the base of transistor Q2, thereby preventing further charging of the capacitor banks 24, 26.

Figure 3:
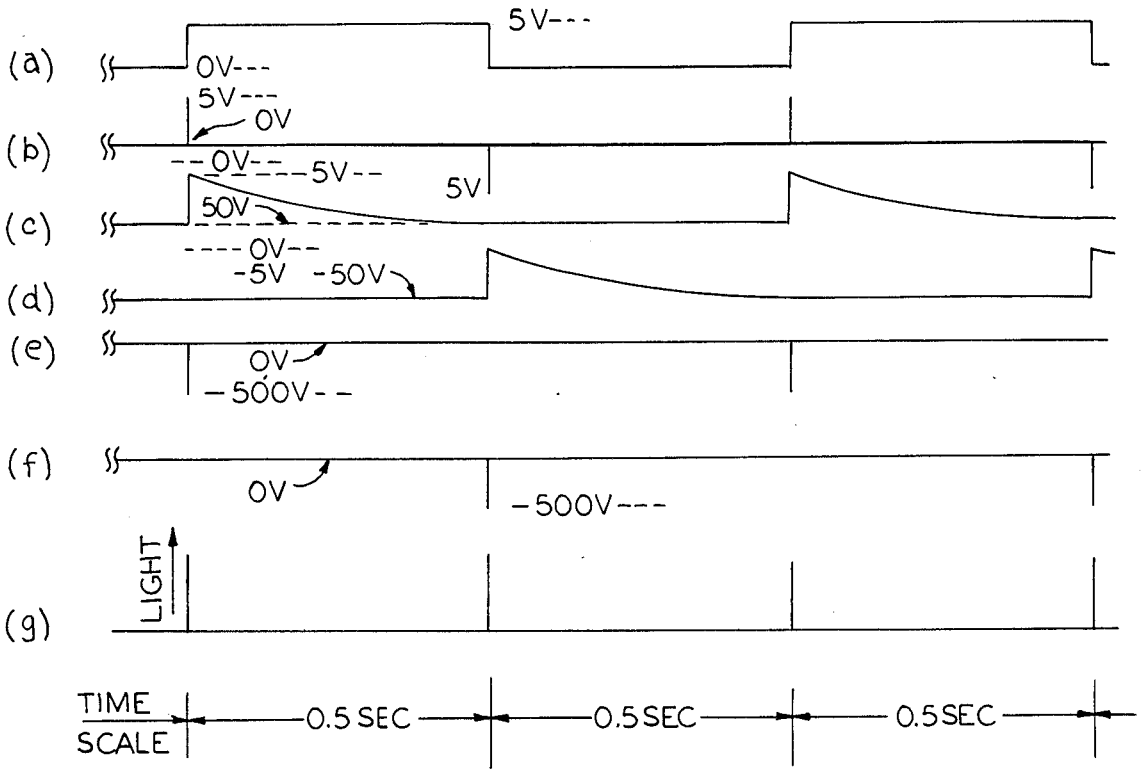
FIGS. 3–5 are timing graphs showing the voltage waveform characteristics at various points in the circuit of FIG. 2.
Figure 4:
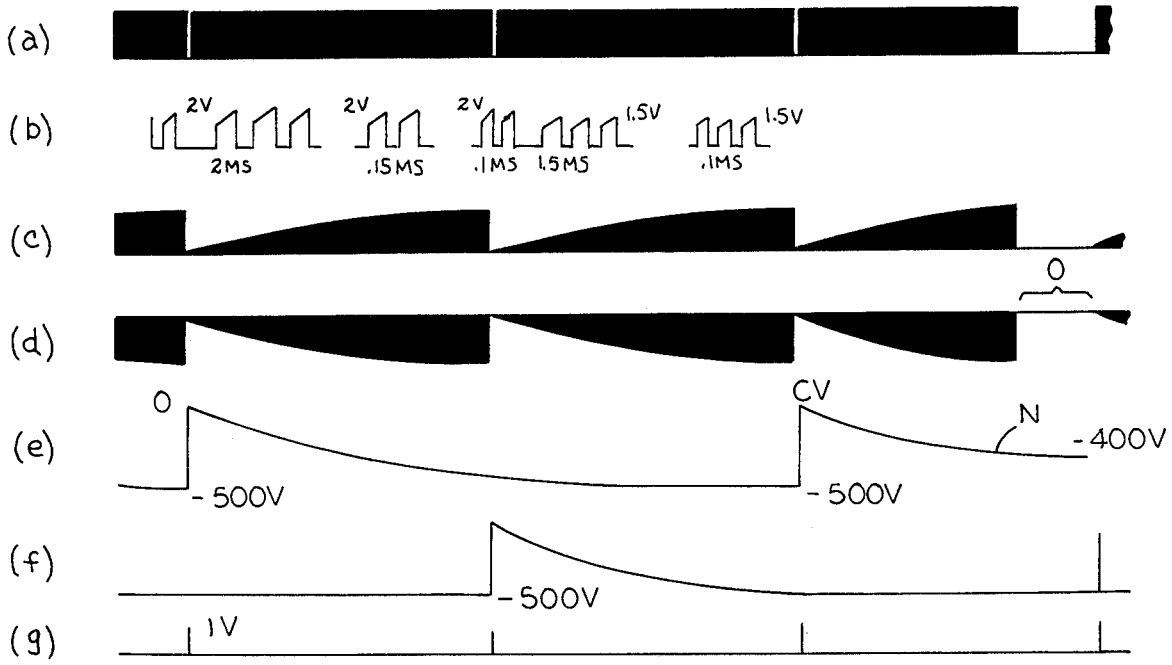
Figure 5:
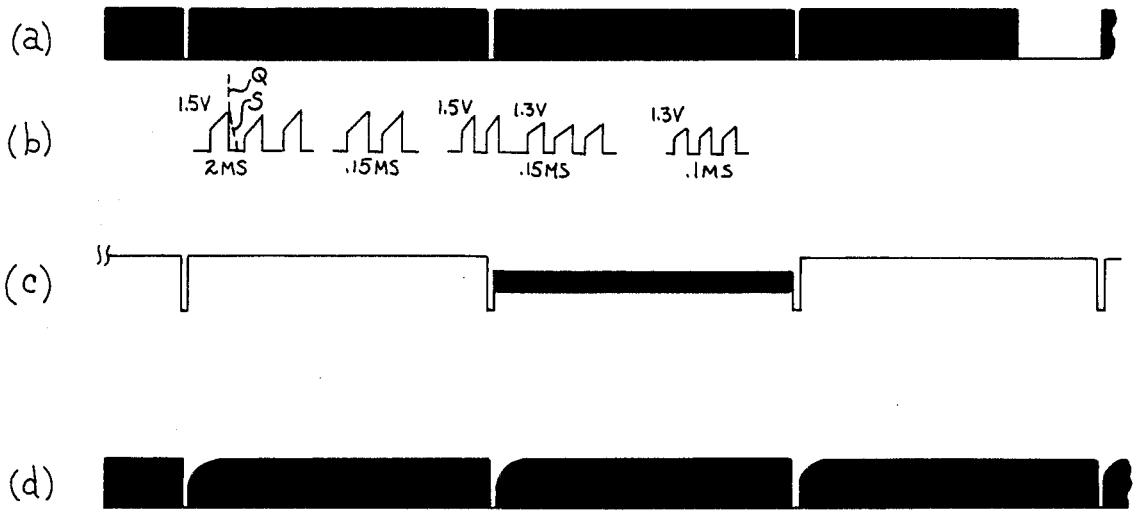

In considering the operation of the power supply of FIG. 2, reference is made to the timing graphs depicted in FIGS. 3–5 of the voltage waveforms at selected points of the circuit of FIG. 2. It is assumed for the convenience of illustration that it is desired to flash each of the lamps 32, 34 at a typical rate of one time per second and alternating at 50% duty cycle. This is accomplished by providing a square wave pulse train at the output A of IC1 in the timing circuit 48 which is one-half second high and one-half second low. This is illustrated in FIG. 3(*a*). While the power supply is shown to flash both lamps 32 and 34, one lamp can be flashed twice or "double" flashed by connecting lines 44 and 46 together via dotted line 45 and joining them to a single lamp. The output B of the differentiating capacitor C5 is shown in FIG. 3(*b*) where positive and negative pulses are synchronized respectively with the leading and trailing edges of each positive half-cycle of the square wave. The positive pulses of FIG. 3(*b*) are coupled by the transformer T1 and capacitor C16 for firing of the gate electrode C of silicon-controlled rectifier CR3 whose waveform is shown in FIG. 3(*c*). Similarly, the negative pulses of FIG. 3(*b*) are coupled by the transformer T1 and capacitor C17 for firing of the gate electrode D of the silicon-controlled rectifier CR6 whose waveform is shown in FIG. 3(*d*). It should be understood that the duty cycle can be adjusted approximately from 1 percent to 99 percent by potentiometers R2 and R3 so as to vary the time interval of the negative pulses relative to the positive pulses.

When the silicon-controlled rectifier CR3 is fired, the large negative potential stored in capacitors C8, C10 will be connected across a main electrodes 100, 102 of the flash tube 108. Simultaneously, an impulse will be applied to the trigger electrode via trigger capacitor 104 and transformer 106 causing the gas in the flash tube 108 to ionize. As a result, the capacitor C8, C10 will discharge through the flash tube 108 and diode CR10. The output E of the power supply due to this discharging is shown in FIG. 3(*e*). When the silicon-controlled rectifier CR6 is fired, the large negative potential stored in capacitor C9, C11 will be connected across the main electrodes 200, 202 of the flash tube 208. Simultaneously, an impulse will be applied to the trigger electrode via a trigger capacitor 204 and transformer 206 causing the gas in the flash tube 208 to ionize. As a result, the capacitor C9, C11 will discharge through the flash tube 208 and the diode CR10. The output F of the power supply due to this discharging is shown in FIG. 3(*f*). Consequently, the intense, short burst of light appearing at a point G of the flash tubes 108 and 208 will have a waveform as shown in FIG. 3(*g*).

The operation of charging incrementally the separate and independent capacitors banks 24, 26 to a voltage level sufficient to flash a respective lamps 32, 34 will now be discussed with particular reference to the waveforms of FIG. 4. The internal ramp oscillator 84 of IC2 has a frequency set by the values of capacitor C13 and resistor R19 and is substantially greater than the output frequency of the timing circuit 48. The oscillator output is used to turn off and on repeatedly a transistor Q1 via squaring circuit 85, NOR gates 86, 87 and transistors Q4, Q5. A signal at the base H of transistor Q1 is shown in FIG. 4(*a*) which appears as a solid block of dark lines with periodic interruptions since the frequency of the oscillator is very fast relative to the timing circuit frequency. Portions of the waveform in FIG. 4(*a*) have been greatly time expanded so as to depict the true signal as is shown in FIG. 4(*b*). As can be seen, each 0.5 sec a quasi-square wave is changing in frequency since the period varies from about 0.2 ms to 0.15 ms to 0.10 ms and repeats from each 0.5 sec in each cycle. The waveforms at the collector I of transistor Q2 and at the secondary winding J of transformer T2 are shown in FIGS. 4(*c*) and 4(*d*) respectively. The incremental charging at point K of capacitors C8, C10 is illustrated in waveform of FIG. 4(*e*), and the incremental charging at point L of capacitor C9, C11 is illustrated in waveform of FIG. 4(*f*). It is to be noted that all of the capacitors are charged negatively with respect to ground.

In order to eliminate the problem of neoning as previously discussed, the oscillator 84 is turned off at the time when an energy storage capacitor banks 24, 26 are being discharged through the respective lamps 32, 34. This is accomplished by disabling of the NOR gates 86, 87 via the current-limit comparator 88 and comparator 82 to prevent base drive to the transistor Q1. The signal at the anode M of the diode CR10 as shown in FIG. 4(*g*) is fed back to the current-limit comparator 88 to perform this disabling function.

For preventing the storage capacitors from being overcharged beyond a predetermined level, the potentiometer R4 is provided to control the amount of voltage of capacitors C9, C11 which is fed back to the error amplifier 90. If the potentiometer R4 is turned fully clockwise so that maximum resistance is in the circuit, the junction of resistors R7 and R11 feeding the non-inverting input of the amplifier 90 will change only slightly, thus allowing the voltage of the capacitors to reach approximately −500 volts before disabling the NOR gates to turn off the oscillator. However, when the potentiometer R4 is turned fully counter-clockwise so that minimum resistance is in the circuit, the junction of the resistors R7 and R11 will receive a large portion of the voltage of the capacitor C9, C11. Therefore, error amplifier 88 will cause the NOR gates to disable sooner. In this example, when the capacitor voltage on C9 reaches approximately −400 volts at point N as seen in FIG. 4(*e*), the oscillator is turned off as can be seen from the area labeled O in FIG. 4(*d*) of the second cycle of the waveform.

In order to prevent the transformer T2 from being saturated, the current at the base P of the transistor Q2 is monitored and is shown in FIG. 5(*a*). FIG. 5(*b*) is a waveform which has been greatly time expanded to provide a better representation of FIG. 5(*a*) showing the fast rising base-emitter voltage (point Q) of the transistor Q2 which is to be avoided. As the potentiometer R21 is turned fully clockwise, the base of the transistor Q3 is set to ground. Thus, the collector R of the transistor Q3 is always high and will not cause disabling of the NOR gate 86, 87. As the potentiometer R19 is turned counter-clockwise, the transistor Q3 will turn on to disable the NOR gates via a comparator 82. The waveform at the collector R is shown in FIG. 5(*c*). As a result, it can be seen from FIG. 5(*b*) that the period of the oscillator is shorter progressively so as to drop the base current drive of the transistor Q1.

In order to insure fast effective shut-off of the oscillator 84, part of the current at the collector I of the transistor Q2 as was shown in FIG. 4(*c*) is fed through components R22, C15, CR8, CR9, CR11 and C14 to disable the NOR gates 86, 87. The resistor R22 and the capacitor C15 function as a differentiator for the waveform of FIG. 4(*c*). A diodes CR9 and CR 11 fixes the level of the pulses between +5.7 volts and +0.7 volts and the diode CR8 permits only the positive pulses to be fed and to pin 3 of IC2 which is unconventional, causing faster shutdown of the NOR gates. As previously mentioned, pin 3 is typically an output of the oscillator to drive other external circuits. A waveform at pin 3 is shown in FIG. 5(*d*) which prevents a slow turn-off time indicated by point S in FIG. 5(*b*).

From the foregoing detailed description of operation, it can thus be seen that the present invention provides an improved flash strobe power supply for delivering repeatedly a single burst of intense energy once every second alternatingly to a pair of flash lamps. Further, by connecting the lines 44 and 46 together by the dotted line 45 and disconnecting the flash lamp 34, the present power supply will deliver repeatedly a double burst of intense energy two times per second to a single flash lamp.

While there has been illustrated and what are at present to be considered to be the preferred embodiments of the present invention, it will be understood by those skilled in the art that various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out this invention, but that the invention will include all embodiments falling within the scope of the appended claims.

What is claimed is:

1. A flash strobe power supply adapted for controlling alternately the energization of a pair of flash lamps, said power supply comprising:

trigger timing means for generating a series of positive pulses and a series of negative pulses spaced in time from said positive pulses by a predetermined interval;

first separate and independent energy storage means for repeatedly charging incrementally during successive charging cycles and for storing a charge to be applied to a first flash lamp;

second separate and independent energy storage means for repeatedly charging incrementally during successive charging cycles and for storing a charge to be applied to a second flash lamp;

inverter oscillator means for generating a quasi-square wave signal whose frequency is greater than the frequency of said positive pulses to control the incremental charging of said first and second storage means, said inverter oscillating means including pulse generating means and a transformer having a primary and a secondary winding;

first switching means for delivering when conductive the charge stored in said first energy storage means to said first flash lamp, said first switching means being responsive to said positive pulses of said timing means for rendering it conductive to permit the discharging of the charge stored in said first energy storage means through said first flash lamp; and second switching means for delivering when conductive the charge stored in said second energy storage means to said second flash lamp, said second switching means being responsive to said negative pulses of said timing means for rendering it conductive to permit the discharging of the charge stored in said second energy storage means to said second flash lamp.

2. A flash strobe power supply as claimed in claim 1, further comprising anti-neoning means responsive to the discharging of said first and second storage means for disabling of said inverter oscillator means at the time of discharging of said first and second storage means through said respective first and second flash lamps so as to prevent charging of said first and second storage means, thereby eliminating a neoning effect.

3. A flash strobe power supply as claimed in claim 1, further comprising overvoltage shut-off means responsive to the charge stored on said second storage means for disabling of said pulse generating means so as to prevent charging of said first and second storage means beyond a predetermined level.

4. A flash strobe power supply as claimed in claim 1, wherein said trigger timing means includes a pulse generator and a differentiating capacitor.

5. A flash strobe power supply as claimed in claim 1, wherein each of said first and second switching means comprises a silicon-controlled rectifier.

6. A flash strobe power supply as claimed in claim 1, wherein each of said first and second energy storage means comprises a capacitor bank.

7. A flash strobe power supply as claimed in claim 1, wherein said inverter oscillator circuit means further comprises a squaring circuit coupled to the output of said pulse generating means and a pair of NOR gates connected to said squaring circuit for disabling of the charging of said first and second energy storage means.

8. A flash strobe power supply adapted for controlling the energization of a flash lamp to produce the effect of a light flash of increased duration of a pair of individual flashes which are closely spaced together, said power supply comprising:

trigger timing means for generating a series of positive pulses and a series of negative pulses spaced in time from said positive pulses by a predetermined interval;

first separate and independent energy storage means for repeatedly charging incrementally during successive charging cycles and for storing a charge to be applied to a flash lamp;

second separate and independent energy storage means for repeatedly charging incrementally during successive charging cycles and for storing a charge to be applied to said flash lamp;

inverter oscillator means for generating a quasi-square wave signal whose frequency is greater than the frequency of said positive pulses to control the incremental charging of said first and second storage means, said inverter oscillating means including pulse generating means and a transformer having a primary and a secondary winding;

first switching means for delivering when conductive the charge stored in said first energy storage means to said flash lamp, said first switching means being responsive to said positive pulses of said timing means for rendering it conductive to permit the discharging of the charge stored in said first energy means through said flash lamp; and second switching means for delivering when conductive the charge stored in said second energy storage means to said flash lamp, said second switching means being responsive to said negative pulses of said timing means for rendering it conductive to permit the discharging of the charge stored in said second energy storage means to said flash lamp.

9. A flash strobe power supply as claimed in claim 8, further comprising anti-neoning means responsive to the discharging of said first and second storage means for disabling of said inverter oscillator means at the time of discharging of said first and second storage means through said flash lamp so as to prevent charging of said first and second energy storage means, thereby eliminating a neoning effect.

10. A flash strobe power supply as claimed in claim 8, further comprising overvoltage shut-off means responsive to the charge stored on said second energy storage means for disabling of said pulse generating means so as to prevent charging of said first and second storage means beyond a predetermined level.

11. A flash strobe power supply as claimed in claim 8, wherein said trigger timing means includes a pulse generator and a differentiating capacitor.

12. A flash strobe power supply as claimed in claim 8, wherein each of said first and second switching means comprises a silicon-controlled rectifier.

13. A flash strobe power supply as claimed in claim 8, wherein each of said first and second energy storage means comprises a capacitor bank.

14. A flash strobe power supply as claimed in claim 8, wherein said inverter oscillator circuit means further comprises a squaring circuit coupled to the output of said pulse generating means and a pair of NOR gates connected to said squaring circuit for disabling of the charging of said first and second energy storage means.

15. A flash strobe power supply adapted for controlling alternately the energization of a pair of flash lamps, said power supply comprising:

trigger timing means for generating a series of positive pulses and a series of negative pulses spaced in time from said positive pulses by a predetermined interval;

first separate and independent energy storage means for repeatedly charging incrementally during successive charging cycles and for storing a charge to be applied to a first flash lamp;

second separate and independent energy storage means for repeatedly charging incrementally during successive charging cycles and for storing a charge to be applied to a second flash lamp;

inverter oscillator means for generating a quasi-square wave signal whose frequency is greater than the frequency of said positive pulses to control the incremental charging of said first and second storage means, said inverter oscillating means including pulse generating means and a transformer having a primary and a secondary winding;

first switching means for delivering when conductive the charge stored in said first energy storage means to said first flash lamp, said first switching means being responsive to said positive pulses of said timing means for rendering it conductive to permit the discharging of the charge stored in said first energy storage means through said first flash lamp;

second switching means for delivering when conductive the charge stored in said second energy storage means to said second flash lamp, said second switching means being responsive to said negative pulses of said timing means for rendering it conductive to permit the discharging of the charge stored in said second energy storage means to said second flash lamp; and antisaturation means responsive to said quais-square wave signal for preventing saturation of the primary winding of said transformer by disabling the pulse generating means to avoid further incremental charging of said first and second energy storage means.

16. A flash strobe power supply as claimed in claim 15, further comprising turn-off feedback means responsive to said quasi-square wave signal for assisting in turning off quickly of said pulse generating mean to insure efficient transfer of energy to the secondary winding of the transformer.

17. A flash strobe power supply as claimed in claim 15, wherein said anti-saturation means comprises a drive transistor having its collector connected to a tap on the primary winding of said transformer and its emitter connected to the base of a power transistor, the base current of said power transistor being sensed to turn on a third transistor to disable said pulse generating means.

18. A flash strobe power supply adapted for controlling the energization of a flash lamp to produce the effect of a light flash of increased duration or a pair of individual flashes which are closely spaced together, said power supply comprising:

trigger timing means for generating a series of positive pulses and a series of negative pulses spaced in time from said positive pulses by a predetermined interval;

first separate and independent energy storage means for repeatedly charging incrementally during successive charging cycles and for storing a charge to be applied to a flash lamp;

second separate and independent energy storage means for repeatedly charging incrementally during successive charging cycles and for storing a charge to be applied to said flash lamp;

inverter oscillator means for generating a quais-square wave signal whose frequency is greater than the fequency of said positive pulses to control the incremental charging of said first and second storage means, said inverter oscillating means including pulse generating means and a transformer having a primary and a secondary winding;

first switching means for delivering when conductive the charge stored in said first energy storage means to said flash lamp, said first switching means being responsive to said positive pulses of said timing means for rendering it conductive to permit the discharging of the charge stored in said first energy storage means through said flash lamp;

second switching means for delivering when conductive the charge stored in said second energy storage means to said flash lamp, said second switching means being responsive to said negative pulses of said timing means for rendering it conductive to permit the discharging of the charge stored in said second energy storage means to said flash lamp; and antisaturation means responsive to said quasi-square wave signal for preventing saturation of the primary winding of said transformer by disabling the pulse generating means to avoid further incremental charging of said first and second energy storage means.

19. A flash strobe power supply as claimed in claim 18, further comprising turn-off feedback means responsive to said quasi-square wave signal for assisting in turning off quickly of said pulse generating means to insure efficient transfer of energy to the secondary winding of said transformer.

20. A flash strobe power supply as claimed in claim 18, wherein said anti-saturation means comprises a drive transistor having its collector connected to a tap of the primary winding of said transformer and its emitter connected to the base of a power transistor, the base current of said power transistor being sensed to turn on a third transistor to disable said pulse generating means.

* * * * *